United States Patent [19]

Mars

[11] Patent Number: 5,068,967

[45] Date of Patent: Dec. 3, 1991

[54] UPRIGHT EATING UTENSIL FOR THE PHYSICALLY DISABLED

[76] Inventor: Suzanne P. Mars, 23649 Duffield Rd., Shaker Hts., Ohio 44122

[21] Appl. No.: 509,468

[22] Filed: Apr. 16, 1990

[51] Int. Cl.[5] ..... A47J 43/28; A47J 43/00

[52] U.S. Cl. ..... 30/324; 30/150

[58] Field of Search ..... 30/324, 323, 327, 296, 30/295, 150; 414/9

[56] References Cited

U.S. PATENT DOCUMENTS

| | | | |
|---|---|---|---|
| 2,487,274 | 11/1949 | Schaffer | 30/327 |
| 2,674,793 | 4/1954 | Dominick | 30/150 |
| 2,995,265 | 8/1961 | Soderberg | 30/327 |
| 3,121,951 | 2/1964 | Green | 30/150 |
| 4,218,167 | 8/1980 | Mansfield | 30/323 |
| 4,821,417 | 4/1989 | Levine | 30/324 |
| 4,835,864 | 6/1989 | Tang | 30/324 |

*Primary Examiner*—Douglas D. Watts

*Assistant Examiner*—Paul M. Heyrana, Sr.

*Attorney, Agent, or Firm*—Weston Hurd Fallon Paisley & Howley

[57] ABSTRACT

The present invention is an eating utensil for the physically disabled. The invention comprises a handle, a shaft and an eating utensil head. The handle functions as both a grasping means and a base means. The handle comprises a vertical cylinder for grasping and a flat bottom surface adapted to rest upon a flat surface such as a table. This flat bottom surface enables the eating utensil to remain upright on the table so that the eating utensil may be easily grasped and picked up. In addition, the utensil head may be modified to increase the surface area available for the food and to increase stability of the food on the eating utensil. The new and improved eating utensil is capable of being used with individuals with a variety of disabilities, particularly those individuals with limited wrist movement.

13 Claims, 2 Drawing Sheets

UPRIGHT EATING UTENSIL FOR THE PHYSICALLY DISABLED

BACKGROUND OF THE INVENTION

1. Field of the Invention

The invention relates to eating utensils which enable people with hand and wrist disabilities, particularly limited range of motion in the wrist, to feed themselves.

2. Description of the Prior Art

Physical disabilities of the hands and wrists make it particularly difficult for people to carry out simple functions of everyday life. In particular, feeding oneself with ordinary eating utensils presents a burdensome task to such individuals, particularly individuals whose wrist movement is limited due to conditions such as arthritis. For conventional eating utensils the non-disabled individual must possess a certain degree of fine motor skills in order to pick up and hold the utensils. In addition, a non-disabled individual using conventional eating utensils must use a variety of different manipulations involving multiple muscles of the hands and arms, and involving multiple joints in the fingers, hands, wrists and elbows. Manipulations require a high degree of coordinated movement in order to successfully feed oneself without dropping or spilling the food. However, for people possessing disabilities, more particularly joint disabilities such as limited wrist movement, picking up and using the eating utensils is painful and requires a tremendous amount of time to execute a simple motion. By "conventional eating utensils" herein, we are referring to forks, knives and spoons known in the prior art which are generally laid out along a single axis and possess thin, small handles of about one-half inch to one inch wide.

While modifications have been made to enlarge the handles of conventional eating utensils to provide an easier grip, this does not eliminate the wrist rotation required to feed oneself with these utensils.

Desirably, eating utensils would be available that would avoid the drawbacks of conventional eating utensils and be capable of use without wrist movement.

SUMMARY OF THE INVENTION

The present invention overcomes the foregoing drawbacks in the prior art and provides a new and improved eating utensil comprising a new and improved handle, a shaft connected at one end to the handle of the eating utensil and connected at the other end to an eating utensil head. The new and improved handle includes a cylindrically shaped handle with a cross-sectional diameter from about ¾ inch to about 2¼ inches, preferably about 1 2/16 inches. The head of the eating utensil may be a spoon known in the prior art, a modified head of a fork known in the prior art, or a modification thereof.

This new and improved eating utensil is capable of being used by individuals with a wide variety of disabilities, including those individuals with limited wrist movement. The invention could also be used by someone with poor or unrefined motor skills, such as a child.

DESCRIPTION OF THE PREFERRED EMBODIMENT

Figure 1:
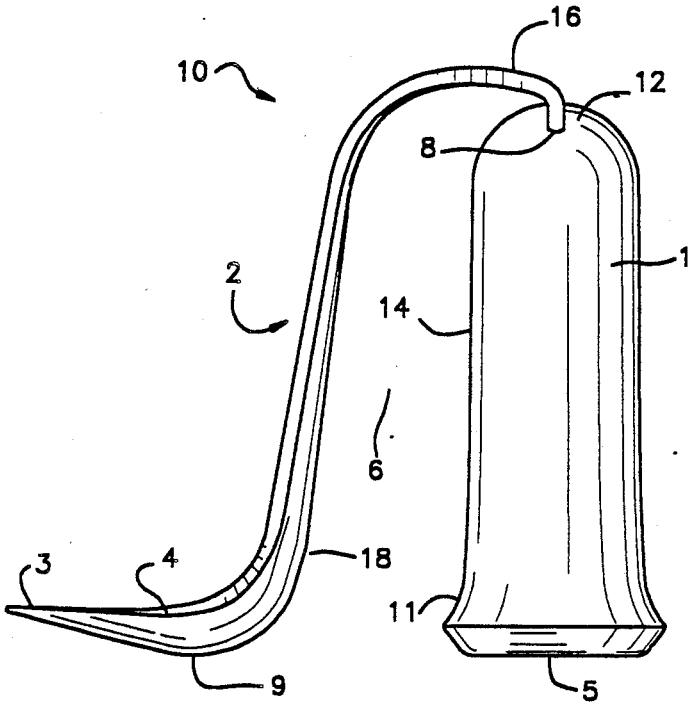
FIG. 1 is a side elevational view of the eating utensil.
Figure 3:
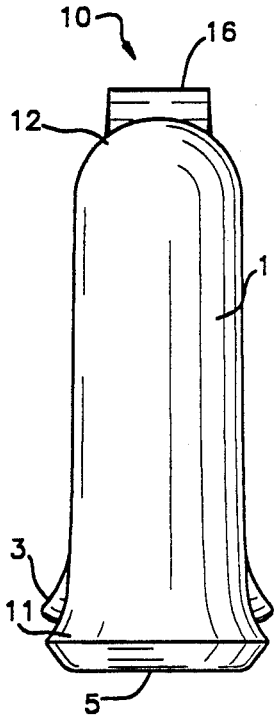
FIG. 3 is a top plan view of the eating utensil.
Figure 2:
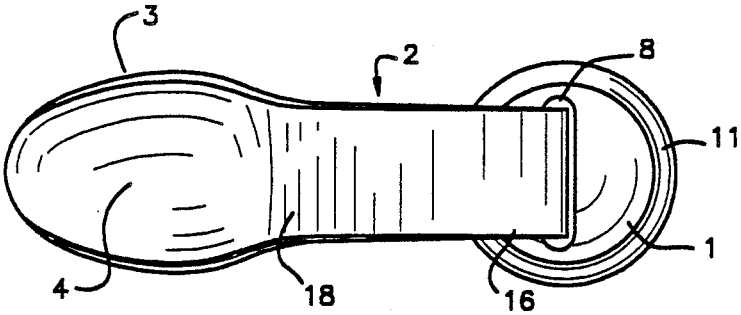
FIG. 2 is a rear elevational view of the eating utensil.
Figure 4:
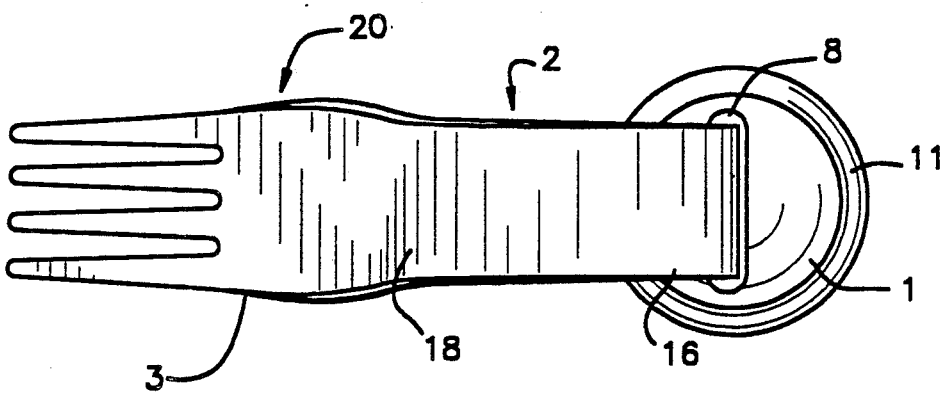
FIG. 4 in a top view of the eating utensil showing the utensil head in the shape of a fork.
Figure 5:
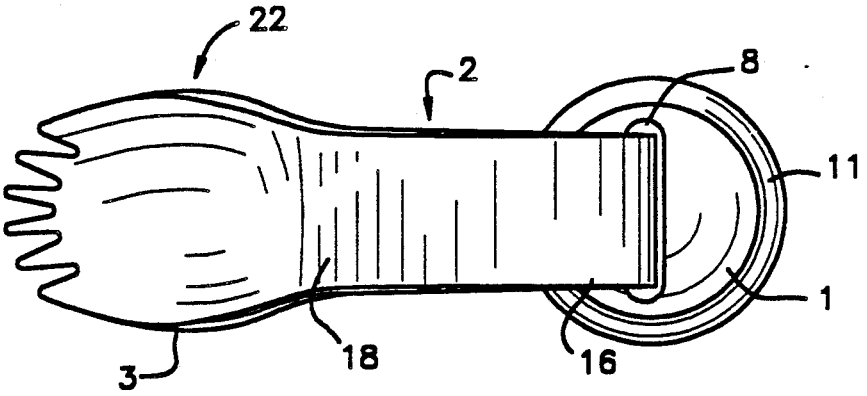
FIG. 5 is a top view of the eating utensil showing the utensil head in the shape of a spork.

Referring to FIGS. 1, 2 and 3 the eating utensil 10 is comprised of a handle 1, a shaft 2 and an eating utensil head 3.

The Handle

The handle 1 functions as both a means for grasping the utensil 10 as well as a means for maintaining the utensil 10 in an upright position. The handle 1 includes a base 5 that has a flat bottom surface, a top portion 12, a flaring portion 11, a side 14 and an orifice 8 which secures the shaft 2 to the handle 1. The handle 1 has a longitudinal axis that extends generally vertically when the base 5 is resting on a horizontal surface. The handle 1 comprises a vertical cylinder with a cross-sectional diameter from about ¾ inch to about 2¼ inches, preferably about 1 2/16 inches. The circumference of the handle 1 makes it easier to grasp than the narrower handles on conventional eating utensils. In addition, the flat bottom surface 5 of the handle 1 is adapted to rest upon a flat horizontal surface such as a table. This flat bottom surface 5 enables the eating utensil 10 to remain upright on the table so that the eating utensil 10 may be easily grasped and easily picked up. Preferably the handle 1 flares out 11 toward the bottom to provide additional support, and for aesthetic considerations.

The height of the handle 1 is from about 3½ inches to 5½ inches, preferably about 3 12/16 inches.

The Shaft

Referring to FIGS. 1 and 2, the shaft 2 of the eating utensil 10 is attached to the top 12 of the handle 1 and gently curves downward and away from the handle 1. The shaft 2 has a longitudinal axis that extends generally parallel to the longitudinal axis of the handle 1. The shaft 2 has a first end 16 that is connected to the handle 1 at a vertical location above the user's fingers when the user is grasping the handle 1, and a second end 18 that is located at a vertical elevation in the vicinity of the base 5. The first end 16 of shaft 2 is adapted to fit into hold 8 of the handle 1 where the shaft 2 may be secured by gluing or welding. The shaft 2 terminates in the eating utensil heat 3. A space 6 is disposed between the shaft 2 and the handle 1. The space 6 between the shaft 2 and the handle 1 must be sufficient to permit a user's fingers to extend between the handle 1 and the shaft 2, from about five-eights of an inch to about two inches, preferably about 1¼ inches (as measured at the widest point). Alternately, the shaft 2 could project out of the side 14 of the handle 1 near the base 5 of the handle 1.

Head

As used herein, the eating utensil head 3 is the part of the eating utensil 10 which is adapted to collect and hold food, and which comes in contact with the mouth.

The eating utensil head 3 is connected to the second end 18 of the shaft 2 and projects laterally from the shaft 2 to lie in a generally horizontal plane when the base 5 of the handle 1 is resting on a horizontal surface. The eating utensil head 3 has a bottom surface 9.

The eating utensil head 3 may be a forkhead 20, a spoonhead 4 or combination of a forkhead and spoonhead, known as a "spork" 22. The head of the spork may be equipped with one or more tines which enable the eating utensil 10 to have the spearing action of a conventional fork. However, the area between the back of the tines and the shaft 2 is enlarged to provide a greater surface area for holding food. In addition, this area between the back of the tines and the shaft 2 may be depressed to give a bowl effect which aids in keeping the food on the eating utensil head 3. In addition the back sides of the eating utensil head 3 may be raised, which helps to keep food from falling off. FIGS. 1 and 2 show a spoonhead 4.

The bottom surface 9 of the eating utensil head 3, which comes in contact with a flat surface such as a table, is flattened to give the eating utensil greater stability and maintain it in an upright position when the eating utensil 10 is not in use.

While one embodiment of the invention has been shown and described, various adaptions and modifications could be made without departing from the scope of the invention as defined in the appended claims.

What is claimed is:

1. An eating utensil for use by persons with limited wrist movement, comprising:

a base adapted to rest upon a horizontal surface;

a handle connected to the base, the handle having a longitudinal axis that extends generally vertically when the base is resting on the horizontal surface;

a shaft having a longitudinal axis that extends generally parallel to the longitudinal axis of the handle, the shaft being spaced from the handle a distance such that the user's fingers can extend between the handle and the shaft, the shaft having a first end that is connected to the handle at a vertical location above the user's fingers when the user is grasping the handle, and a second end that is located at a vertical elevation in the vicinity of the base; and a utensil head connected to the second end, the utensil head projecting laterally from the shaft to lie in a generally horizontal plane when the base is resting on the horizontal surface.

2. The eating utensil of claim 1, wherein the handle is cylindrically shaped.

3. The eating utensil of claim 1, wherein the handle has a height from about 3–½ inches to about 5½ inches.

4. The eating utensil of claim 1, wherein the handle has a height of about 3 12/16 inches.

5. The eating utensil of claim 1, wherein the handle has a cross-sectional diameter from about ¾ inch to about 2¼ inches.

6. The eating utensil of claim 1, wherein the handle has a cross-sectional diameter of 1 2/16 inches.

7. The eating utensil of claim 1, wherein the shaft attaches to the top of the handle.

8. The eating utensil of claim 1, wherein the shaft curves downward from the point of attachment to the handle to the utensil head.

9. The eating utensil of claim 1, wherein the utensil head is in the shape of a spoon.

10. The eating utensil of claim 1, wherein the utensil head is in the shape of a fork.

11. The eating utensil of claim 1, wherein the utensil head has a flat bottom surface.

12. The eating utensil of claim 1, wherein the utensil head is in the shape of a spork.

13. The eating utensil of claim 11, wherein the flat bottom surface lies in the same plane as the base.

* * * * *

UNITED STATES PATENT AND TRADEMARK OFFICE

CERTIFICATE OF CORRECTION

PATENT NO. : 5,068,967

DATED : December 3, 1991

INVENTOR(S) : Suzanne P. Mars

It is certified that error appears in the above-identified patent and that said Letters Patent is hereby corrected as shown below:

Col. 2, line 49, delete "heat" and insert --head--.
line 58, delete "Head" and insert --The Eating Utensil Head--.

Signed and Sealed this

Eighteenth Day of May, 1993

*Attest:*

Michael K. Kirk

MICHAEL K. KIRK

*Attesting Officer*

*Acting Commissioner of Patents and Trademarks*